US005095964A

United States Patent [19]

Kraeutler

[11] Patent Number: 5,095,964

[45] Date of Patent: Mar. 17, 1992

[54] GOODS-HANDLING DOOR COMPRISING A RAISABLE CURTAIN WITH ANTI-FLAPPING THRUST MEANS

[75] Inventor: Bernard Kraeutler, Dunieres, France

[73] Assignee: Nergeco (SA), Dunieres, France

[21] Appl. No.: 567,006

[22] Filed: Aug. 13, 1990

[30] Foreign Application Priority Data

Aug. 17, 1989 [FR] France ..... 89 10961

[51] Int. Cl.[5] ..... E06B 9/06

[52] U.S. Cl. ..... 160/84.1; 160/269

[58] Field of Search ..... 160/84.1, 270, 271, 160/276, 275, 269, 273.1

[56] References Cited

U.S. PATENT DOCUMENTS

| | | | |
|---|---|---|---|
| 236,126 | 12/1880 | Washburn | 160/276 |
| 594,224 | 11/1897 | Barth | 160/264 |
| 827,901 | 8/1906 | Barr | 160/269 |
| 1,725,307 | 8/1929 | Sembower | 160/264 |

FOREIGN PATENT DOCUMENTS

| | | |
|---|---|---|
| 949720 | 9/1956 | Fed. Rep. of Germany . |
| 63908 | 2/1972 | Luxembourg . |
| 406597 | 8/1966 | Switzerland . |

*Primary Examiner*—Blair M. Johnson
*Attorney, Agent, or Firm*—Iandiorio & Dingman

[57] ABSTRACT

A goods-handling door of the raisable type, the door comprising a flexible or hinged curtain, optionally having horizontal reinforcing bars and capable of being wound, folded concertina-like, or displaced above the door, the edges of the curtain sliding between the side walls of vertical slideways which are spaced substantially further apart than the thickness of the curtain, or of the reinforcing bars, if any, with thrust means being provided in each slideway for thrusting the edge of the curtain against one of the side walls of the slideway. Each thrust means is constituted by an elongate element, is resiliently held in a horizontal position by a resilient hinge disposed between one of the ends of the thrust means and one of the walls of the slideway, and is shorter than the spacing between the side walls of the slideway so as to leave a gap substantially equal to the thickness of the curtain or to the thickness of a reinforcing bar, if any.

17 Claims, 1 Drawing Sheet

GOODS-HANDLING DOOR COMPRISING A RAISABLE CURTAIN WITH ANTI-FLAPPING THRUST MEANS

BACKGROUND OF THE INVENTION

The present invention relates to goods-handling doors and other articulated panels for industrial buildings, hangars, or the like, which doors are of the type having a raisable curtain constituted by a curtain that is flexible or hinged, and usually reinforced by horizontal reinforcing bars disposed at regular intervals. The curtain may be wound up to the top of the door, or folded concertina-like by means of lifting straps fixed to its bottom bar, which straps are wound onto a shaft disposed above the curtain. The edges of the curtain and/or the ends of the reinforcing bars may be guided by moving in slideways formed in or by lateral uprights which generally support a top horizontal cross-member which supports drive means, and in particular the shaft for winding up the lifting straps or the curtain itself.

In order to enable the curtain to be raised and lowered easily without excessive friction or risk of curtain jamming, the slideways need to be rather wide. However, when the door is closed (curtain down), the curtain may flap between the edges of the slideways, thereby making noise and possibly also damaging the curtain.

Systems have been devised for pressing the curtain against one of the edges of each slideway, such as the system described in French patent No. 2 548 257, for example. The curtain is ballasted by a bottom bar and when this bar reaches the bottom it actuates a device by mechanical means or by means of a relay, thereby causing the curtain to be pressed against one of the edges of each slideway. These systems prevent the curtain from flapping but they are fragile and they may jam the curtain in its closed position.

The object of the present invention is to provide a device which is simple, cheap, effective, and reliable.

SUMMARY OF THE INVENTION

The present invention therefore provides a goods-handling door of the raisable type, the door comprising a flexible or hinged curtain, optionally having horizontal reinforcing bars and capable of being wound, folded concertina-like, or displaced above the door, the edges of the curtain sliding between the side walls of vertical slideways which are spaced substantially further apart than the thickness of the curtain, or of the reinforcing bars, if any, with thrust means being provided in each slideway for thrusting the edge of the curtain against one of the side walls of the slideway, wherein each thrust means:

is constituted by an elongate element;

is resiliently held in a horizontal position by a resilient hinge disposed between one of the ends of the thrust means and one of the walls of the slideway; and is shorter than the spacing between the side walls of the slideway so as to leave a gap substantially equal to the thickness of the curtain or to the thickness of a reinforcing bar, if any.

When the curtain is down, the thrust means keeps it pressed against one of the side walls of the slideway. When the curtain is moving, it entrains the thrust means in the direction of its motion away from its equilibrium position. Because of the resilient flexibility of its fixing, the thrust means remains retracted during motion of the curtain and does not hinder curtain motion. As soon as the curtain stops, the thrust means returns to its horizontal equilibrium position.

If the curtain is reinforced by rigid elements, such as reinforcing bars or panels, then the thrust means should be located level with these elements when the curtain is in its down or closed position. If the reinforcing means are bars, then the free end of each thrust means may be shaped with a recess for fitting over the extra thickness of the reinforcing bar.

BRIEF DESCRIPTION OF THE DRAWINGS

An embodiment of the invention is described by way of example with reference to the accompanying drawings, in which.

DETAILED DESCRIPTION

The invention is described by way of non-limiting example with reference to a raisable flexible curtain 1 provided at regular intervals with horizontal reinforcing bars 2. The curtain may be a curtain which is wound onto a drum or which is folded concertina-like at the top of the door. It slides in slideways comprising pairs of side walls 3A and 3B which are spaced considerably further apart than the thickness of the reinforcing bars 2.

Figure 1:
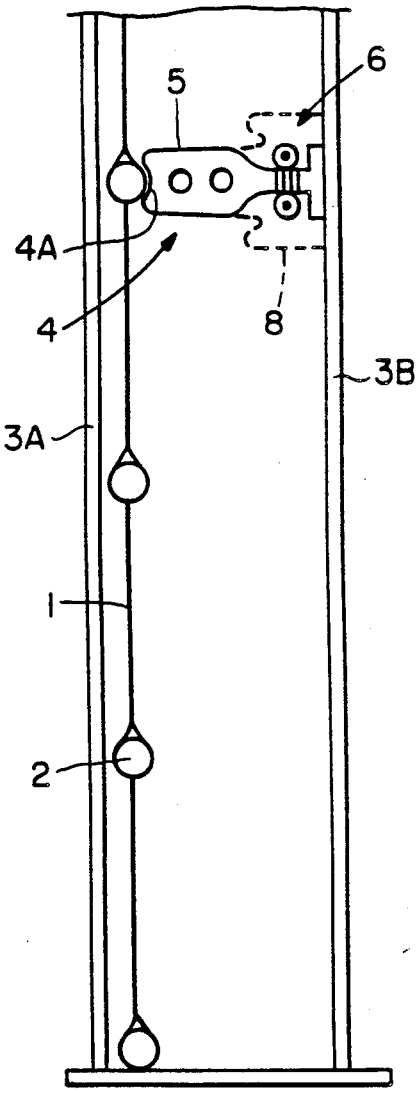
FIG. 1 is a fragmentary elevation view of a slideway as seen from within the plane of the curtain, the curtain and its reinforcing bars being shown in section, and thrust means being shown in a rest position.

In order to prevent the curtain from flapping against the walls of the slideways, the invention uses thrust means 4 which are advantageously disposed at the same levels as the reinforcing bars when the curtain is down (only one thrust means is shown in FIG. 1). A thrust means comprises an elongate member 5 and a resilient hinge 6. The elongate member may be made of any suitable material, preferably a sounddeadening material such as wood, plastic, or rubber, and it may have holes 7 for reducing its weight and is inertia. The function of the resilient hinge is to keep the thrust member in a horizontal position so long as no force is applied thereto. The resilient hinge may be constituted, as shown, by a doubleacting hinge of the type used for doors that swing in both directions, with resilient return means.

The hinge could alternatively be constituted by a spring blade, a length of coil spring, etc.

The hinge is fixed to one side wall 3B of the slideway, and in the rest position the distant free end 4A of the thrust means is at a distance from the opposite side wall 3A of the slideway substantially equal to the thickness of a reinforcing bar.

When the thrust means 4 is situated at the level of a reinforcing bar, its free end 4A may be concave to match the outline of the bar.

Figure 2:
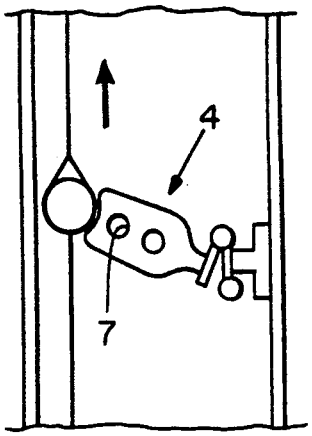
FIG. 2 is a view analogous to FIG. 1 showing the situation while the curtain is moving upwards.
Figure 3:
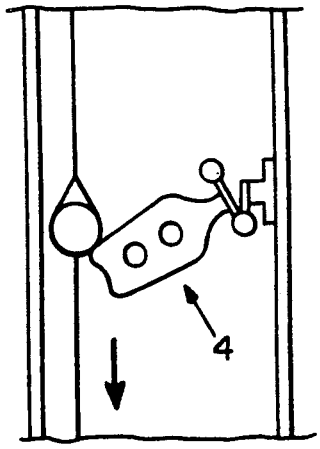
FIG. 3 is a view analogous to FIG. 2, showing the situation while the curtain is moving downwards.

During curtain motion, the thrust means is displaced by virtue of its resilient hinge and it does not prevent the bars going past. When the curtain is going up (FIG. 2) the bar begins by raising the top edge of the end cavity in the thrust means. Thereafter, once the bar has escaped, the thrust means falls back to its horizontal position until the following bar raises it in order to go past.

Curtain lowering takes place in the same way. When a bar engages a thrust means, it pushes it down by deforming or folding the resilient hinge. After a bar has gone past, the resilient hinge raises the thrust means until the next bar arrives.

The vertical extent of the free end 4A of the thrust means (i.e. its extent perpendicular to its length) is limited in order to avoid jamming by rotation about the hinge. The hinge end thereof should also be of limited vertical extent in order to leave hinge operation sufficiently free. Because of these conditions, the general shape of the thrust means is elongate. But apart from these constraints, the shape may be arbitrary.

In order to protect the hinge from dust and avoid the risk of the curtain being damaged or pinched by the hinges, the hinges may be protected by respective bellows 8 (shown in dashed lines in the section of FIG. 1). Such bellows allow the thrust means to move freely.

I claim:

1. A goods-handling door of the raisable type, the door comprising a curtain, the edges of the curtain sliding between the side walls of vertical slideways which are spaced substantially further apart than the thickness of the curtain, with thrust means being provided in each slideway for thrusting the edge of the curtain against one of the side walls of the slideway, wherein each thrust means:

is constituted by an elongate element;

is resiliently held in a horizontal position by a resilient hinge disposed between one of the ends of the thrust means and one of the walls of the slideway; and is shorter than the spacing between the side walls of the slideway so as to leave a gap substantially equal to the thickness of the curtain.

2. A door according to claim 1, wherein the free end of the thrust means is formed with a hollow adapted to match the outline of a curtain reinforcing bar.

3. A door according to claim 1, wherein the resilient hinge is of the double-acting hinge type.

4. A door according to claim 1, wherein the resilient hinge is enclosed in a protective bellows.

5. A door according to claim 1, wherein said curtain is a flexible curtain.

6. A door according to claim 1, wherein said curtain is a hinged curtain.

7. A door according to claim 1, wherein said curtain is capable of being wound.

8. A door according to claim 1, wherein said curtain is capable of being folded concertina-like.

9. A door according to claim 1, wherein said curtain is capable of being displaced about the door.

10. A goods-handling door of the raisable type, the door comprising a curtain having horizontal reinforcing bars, the edges of the curtain sliding between the side walls of vertical slideways which are spaced substantially further apart than the thickness of the reinforcing bars, with thrust means being provided in each slideway for thrusting the edge of a curtain against one of the side walls of the slideway, wherein each thrust means;

is constituted by elongate element;

is resiliently held in a horizontal position by a resilient hinge disposed between one of the ends of the thrust means and one of the walls of the slideways; and is shorter than the spacing between the side walls of the slideway so as to leave a gap substantially equal to the thickness of reinforcing bar.

11. A door according to claim 10, wherein the resilient hinge is of the double-acting hinge type.

12. A door according to claim 10, wherein the resilient hinge is enclosed in a protective bellows.

13. A door according to claim 10, wherein said curtain is a flexible curtain.

14. A door according to claim 10, wherein said curtain is a hinged curtain.

15. A door according to claim 10, wherein said curtain is capable of being wound.

16. A door according to claim 10, wherein said curtain is capable of being folded concertina-like.

17. A door according to claim 10, wherein said curtain is capable of being displaced above the door.

* * * * *